US007048156B2

(12) United States Patent
Weck et al.

(10) Patent No.: US 7,048,156 B2
(45) Date of Patent: May 23, 2006

(54) LIQUID SPRAY DISPENSER AND SUCTION TUBE THEREFOR

(75) Inventors: David Weck, Miami, FL (US); Erwin Frey, Ft. Lauderdale, FL (US); Edson A. Mejia, Miami, FL (US)

(73) Assignee: Micasa Trading Corporation, Miami, FL (US)

( * ) Notice: Subject to any disclaimer, the term of this patent is extended or adjusted under 35 U.S.C. 154(b) by 0 days.

(21) Appl. No.: 10/829,163

(22) Filed: Apr. 22, 2004

(65) Prior Publication Data

US 2005/0236433 A1 Oct. 27, 2005

(51) Int. Cl.
*B67D 5/42* (2006.01)

(52) U.S. Cl. ..... 222/382; 222/377; 222/464.7

(58) Field of Classification Search ..... 222/382, 222/464.7, 464.1, 377, 189.1
See application file for complete search history.

(56) References Cited

U.S. PATENT DOCUMENTS 3,209,954 A * 10/1965 Webster ..... 222/189.1
5,083,683 A * 1/1992 Knickerbocker ..... 222/382
5,518,150 A * 5/1996 Witt, Jr. ..... 222/382
6,059,152 A * 5/2000 Mayfield ..... 222/382

* cited by examiner

*Primary Examiner*—Philippe Derakshani
(74) *Attorney, Agent, or Firm*—Lowe, Hauptman & Berner, LLP

(57) ABSTRACT

A liquid dispenser bottle includes a suction tube and a spray nozzle. An end of the tube abuts an intersection of the bottle base and wall when the bottle is in use. A screen extending between opposite sides of a wall of the tube at the end where the intersection is located overcomes a tube tendency to collapse and enables liquid to flow from the corner of the bottle into the tube. Aesthetic undulations in the bottle wall cause liquid to flow therefrom toward the base when the bottle is vertically disposed, so liquid is not retained in the undulations.

29 Claims, 6 Drawing Sheets

FIG. 1
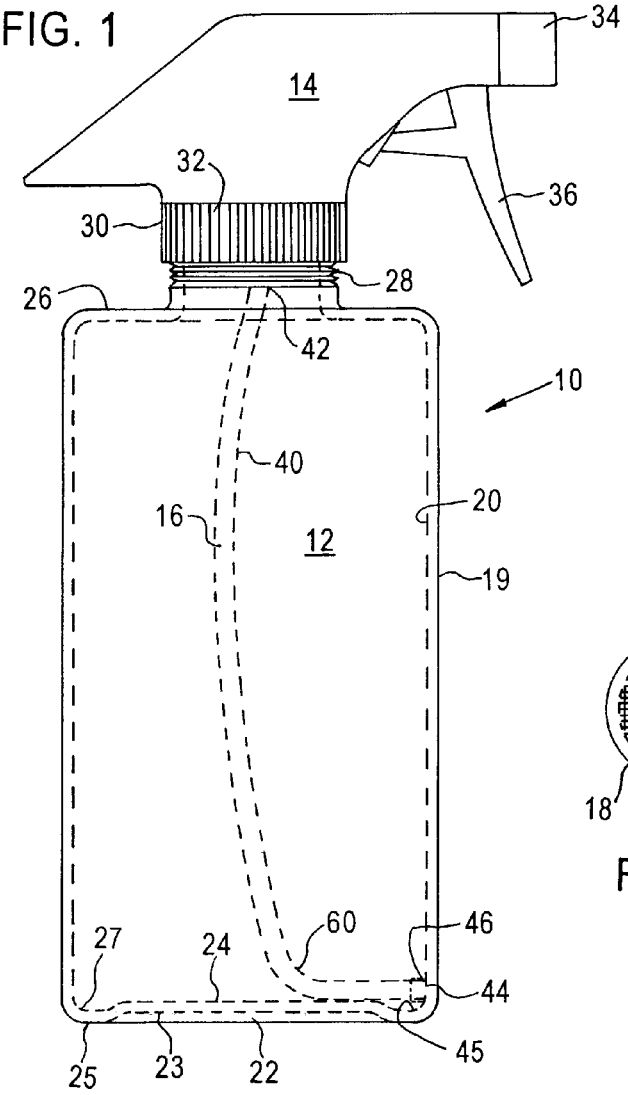
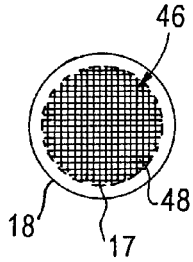
FIG. 2
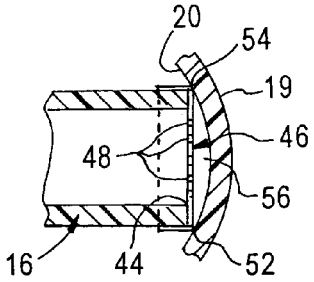
FIG. 4
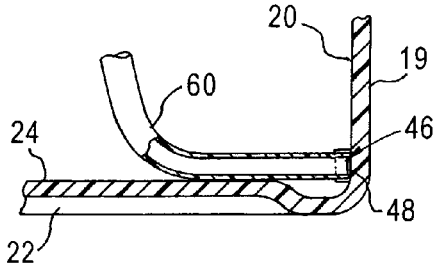
FIG. 3

LIQUID SPRAY DISPENSER AND SUCTION TUBE THEREFOR

FIELD OF THE INVENTION

The present invention relates in general to liquid spray dispensers and, more particularly, to a tube for use with a liquid dispenser bottle having a spray nozzle, and to a liquid spray dispenser including a bottle, a nozzle, and such a tube. Another aspect of the present invention relates to bottles for liquid spray dispensers.

BACKGROUND ART

One type of liquid dispenser includes a bottle for holding a liquid, a spray nozzle on top of the bottle, and a suction tube carried by the spray nozzle and extending into the bottle. Some of the liquid dispensers of the foregoing type are designed so that the suction tube is curved and has an open end in proximity to a corner of the bottle at the lowest point of the bottle when the bottle is in use, spraying liquid from the bottle onto an object.

Typically, the open end of the bottle has an elliptical shape for enabling the end of the tube to be in closest proximity to the corner. Users of such bottles usually try to position the bottle so that the liquid is removed to the greatest extent from the bottle when the liquid supply is almost exhausted from the bottle. However, a considerable portion of liquid frequently remains in the bottle. The cumulative effect of the liquids remaining in bottles with almost exhausted liquid supplies is substantial, resulting in a substantial waste of the liquid. In addition, some of the liquids have adverse environmental effects.

Accordingly, it is an object of the present invention to provide a liquid dispenser of the type including a bottle, a spray nozzle, and a suction tube, wherein virtually no liquid remains in the bottle and the liquid in the bottle becomes virtually completely exhausted, provided the dispenser is judiciously used.

Typically, conventional liquid dispenser bottles have non-descriptive shapes that do not contribute to marketing of the product including the bottle, liquid, spray nozzle, and suction tube.

It is, accordingly, another object of the present invention to provide a bottle for a liquid dispenser, wherein the bottle has an ascetically pleasing shape and wherein the bottle shape is such as to enable the liquid in the bottle to flow toward the lowest corner of the bottle while the bottle is in use.

An additional object of the present invention is to provide a new and improved bottle for a liquid dispenser, wherein the bottle has an ascetically pleasing shape, enabling the bottle to be easily grasped by a user.

SUMMARY OF THE INVENTION

An aspect of the invention relates to a suction tube for use with a liquid dispenser bottle having a known size and shape in combination with a spray nozzle positioned on the bottle. The spray nozzle has a structure for receiving and holding a first end of the tube. The tube comprises a wall having a length and shape between the first end thereof and a second end thereof such that the tube, when held by the spray nozzle and in place in the bottle, has the second end thereof abutting an intersection of the bottle base and wall. The intersection is the lowest point of the bottle when the bottle is in use and liquid is almost exhausted from the bottle. The tube wall is constructed so that the tube wall has a tendency to collapse in response to contact occurring between the tube wall or base and the bottle. The second end has a structure extending between opposite sides of the tube wall for strengthening the tube wall and overcoming the tendency of the tube wall to collapse. The structure at the second end of the tube includes an opening arrangement for enabling the liquid to flow from the corner of the bottle into the tube.

Another aspect of the invention relates to a liquid spray dispenser comprising a liquid dispenser bottle, a spray nozzle, and a suction tube. The spray dispenser is arranged to carry the suction tube. An upper end of the bottle is arranged for carrying the spray nozzle. The bottle includes walls that extend between the spray nozzle and a base. The wall, base, and nozzle are arranged so an intersection of the base and wall is at the lowest point of the bottle when the wall of the bottle is generally horizontally disposed and the nozzle is pointing downward. The wall has an undulation for (a) causing a liquid in the bottle to flow from the undulation toward the base while the bottle wall is vertically disposed, and (b) preventing retention of the liquid in the undulation while the bottle wall is vertically disposed and the volume of liquid in the bottle is less than the volume of the bottle below the lowest part of any of the undulations.

Preferably, the structure at the second end of the tube includes a substantially planar surface on the exterior of the tube and the planar surface has a perimeter that is the about same as the perimeter of the exterior of the wall of the tube at the second end of the tube.

In a first embodiment, the exterior of the wall of the tube at the second end of the tube has a circular face substantially at right angles to the length of the tube. In a second embodiment, the exterior of the wall of the tube at the second end of the tube has an elliptical face that extends along a diagonal relative to the length of the tube and the wall of the tube is circular in cross-section.

In the first embodiment, the bottle base and wall preferably have circular interior perimeters and the intersection is between (a) a portion of the bottle wall having the circular interior cross-sectional surface and (b) the circular perimeter of the base.

In the second embodiment, the tube preferably extends arcuately between the nozzle and intersection so there is contact of the tube and the bottle only where the second end abuts the intersection.

To provide an aesthetic effect the undulations are preferably shaped to simulate petals of a plant. The bottle wall has substantially straight segments between the bottom portions of the petals and the base. The straight segments are on opposite sides of the bottle. A first of the straight segments on a first side of the bottle leads to the intersection, while a second of the straight segments on a second side of the bottle leads to a second intersection, where the liquid forms a pool when the liquid is almost exhausted. A second side of the bottle is opposite to the first side of the bottle and the second intersection is opposite to the first intersection. The wall has third and fourth opposite sides tapering outwardly toward the base from an end of the bottle receiving the spray nozzle. The straight segment of the first side of the bottle leading toward the intersection where the pool is formed has a smaller angle relative to the base than the straight segment and the second side of the base to provide the desired flow effect of liquid droplets from the wall to the base.

Preferably, the undulations are shaped and sized so that the first and second sides of the wall include crevices for receiving the four fingers and thumb of a user while the index finger of the user engages a trigger of the spray nozzle.

Preferably the base and wall of the bottle have rounded corners at the intersections thereof to increase stability of the bottle while the bottle is sitting on a flat horizontal surface.

The above and still further objects, features and advantages of the present invention will become apparent upon consideration of the following detailed description of specific embodiments thereof, especially when taken in conjunction with the accompanying drawings.

BRIEF DESCRIPTION OF THE DRAWINGS

FIG. 1 is a side view of a liquid spray dispenser including a cylindrical bottle, spray nozzle, and suction tube in accordance with an embodiment of the present invention;

FIG. 2 is a front view of the tube of FIG. 1;

FIG. 3 is a side sectional view of a portion of the liquid spray dispenser of FIG. 1, wherein the tube runs along a bottom face of the bottle and has edges abutting an intersection of the bottle wall and base;

FIG. 4 is a top view of the intersection where the tube meets the cylindrical wall and base of the bottle in the embodiment shown in FIGS. 1–3;

DETAILED DESCRIPTION OF THE DRAWINGS

Figure 5:
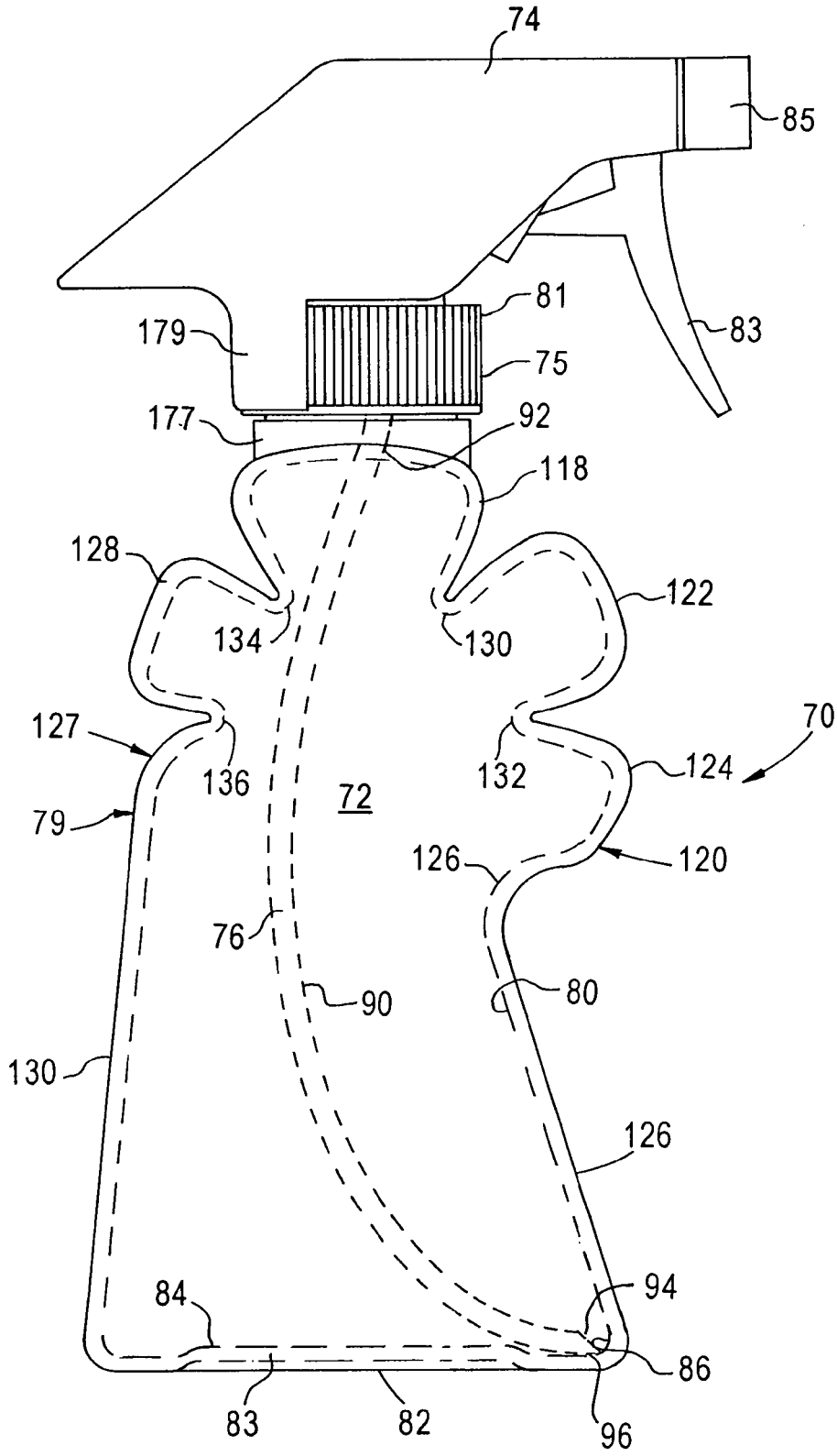
FIG. 5 is a side view of another embodiment of a liquid spray dispenser including a suction tube having a tip abutting an intersection between a substantially rectangular base and flat side of a wall of a bottle.

Reference is now made to FIGS. 1–4 of the drawings, wherein liquid spray dispenser 10 is illustrated as including bottle 12, liquid spray nozzle 14, and suction tube 16 having inner and outer walls 17 and 18, both of which have circular cross-sections. Bottle 12 can store suitable liquids of many different types. For example, bottle 12 stores an enzyme-based odor-reducing or -removing liquid. Each of bottle 12, spray nozzle 14, and suction tube 16 is preferably made of a plastic material, with walls of the tube being sufficiently thin that the walls have a tendency to kink and to block the flow of liquid from bottle 12 through spray nozzle 14 as a result of contact between the spray tube and bottle unless precautions, as described herein, are taken.

Bottle 12 includes a cylindrical wall 19 having an inner surface 20 with a circular cross-section in planes at right angles to the longitudinal axis of the bottle. Bottle 12 includes circular base 22 having planar, circular interior face 24. Bottle 12 also includes, at the top of wall 19, shoulder 26 extending between wall 19 and neck 28 having helical threads upon which the nozzle 14 is screwed in a conventional manner. Base 22 includes a planar, circular outer face 23 surrounded by circular, annular ridge 25 that downwardly depends from face 24. Ridge 25 connects base 22 to wall 19 and causes annular gutter 27 to be formed between interior, planar surface 24 of base 22 and inner surface 20 of wall 19. Intersection 45 between wall 19 and base 22 is at the lowest point of gutter 27.

Liquid spray nozzle 14 includes flange 30 having a curvature and internal threads (not shown) mating with the curvature and threads of neck 28, and longitudinally extending grooves that enable nozzle 14 to be hand tightened on neck 28. Spray nozzle 14 includes nozzle head 34 with a spray aperture in fluid-flow relation with tube 16. Nozzle head 34 is turnable to activate a valve therein to turn on and off the flow path between the interior of tube 16 and the nozzle spray aperture. Liquid spray nozzle 14 also includes trigger 36. Nozzle 14 is of a conventional type and need not be described further other than to note that in response to squeezing trigger 36 toward neck 28, the nozzle applies negative pressure to the end of the nozzle connected to suction tube 16, to draw liquid from bottle 12. The liquid is sprayed in droplets through the spray outlet in head 34.

Tube 16 includes elongated portion 40, as well as a first end 42 carried by spray nozzle 14 so that tube end 42 is centrally located, coaxial with neck 28. Tube 16 has a second end 44 capped by a stiff, plate-like circular cover 46 that extends completely across the second end 44 of tube 16. Tube 16 is continuous and has no openings between ends 42 and 44. Tube 16 has a thin wall, enabling it to be relatively easily bent and kinked, particularly in response to contact with the stiffer surfaces of bottle 12.

The circumference of the circular end face of cover 46 is coincident with the circular perimeter of outer tube wall 18. Plate-like cover 46 is formed as a screen including numerous holes 48 that provide a fluid flow path between the outer face of cover 46 and the interior of tube 16. Cover 46 stiffens tube 16 and overcomes the tendency for the tube to kink or collapse as a result of contact between the tube and surfaces of the bottle 12.

Tube 46 has a length such that the tube extends for a substantial distance along interior surface 24 of base 22. To this end, the length of suction tube 16, between the first and second ends thereof, considerably exceeds the straight line distance between the point where first end 42 of the suction tube is held in place on spray nozzle 14 to intersection 45. The length of tube 16 is such that the elongated portion of the tube is, in the cross-section of FIG. 1, shaped as an arc between end 42 and the contact point of the tube with interior base surface 24. The arc bows in a direction away from the wall where intersection 45 is located. Typically, elongated portion 40 of tube 16 between ends 42 and 44 is sufficiently long that the tube engages base surface 24 approximately in the center of the base surface. Because of the circular shape of inner wall surface 20 and interior base surface 24, the angular position of tube 16 with respect to surface 24 is not critical.

Tube 46 is sufficiently long that its end 46 wedges against intersection 45 between base 24 and wall 19, along the interior surface 20 of the wall. As a result, cover 46 has two points 52, 54 (FIG. 4) that abut inner surface 20 of wall 19 in very close proximity to intersection 45 of surface 20 of wall 19 and interior surface 24 of base 22. Points 52, 54 are diametrically opposed to each other and abut corresponding points on inner wall surface 20 to form pocket 56, defined by the exterior face of cover 46 and the inner surface 20 of wall 19. Pocket 56 is shaped in cross-section as a sector of a circle, wherein the sector is defined by wall surface 20 and the exterior face of cover 46.

In operation, bottle 19 is typically held so that the longitudinal axes of the bottle and tube 16 extend in a generally vertical direction. In response to a user squeezing trigger 36, liquid flows from the bottle 12 through openings 48 into the interior of suction tube 16 through a passage in nozzle 14 to the nozzle spray outlet. As the supply of liquid in bottle 12 is exhausted, the user of the liquid spray dispenser of FIGS. 1–4 has a tendency to tilt the bottle so that intersection 45 where end 46 of tube 16 is located is the lowest point of the bottle, so that the almost-exhausted liquid has a tendency to pool in the vicinity of the intersection. Because the outer face of cover 46 has opposite points 52 and 54 (FIG. 4) in contact with the circular inner surface 20 of wall 19, immediately above intersection 45, virtually all the liquid pooled at the intersection is sucked into tube 16 in response to trigger 36 being squeezed. Sucking continues until a sufficient area of openings 48 is exposed to air to cause a substantial amount of air to be sucked into the interior of tube 16.

Because of the rigidity provided to tube end 44 by the end of cover 46, the liquid flows freely through suction tube 16, which is not subject to kinking as a result of bend 60 of tube 16 at its intersection with the interior face 24 of base 22, approximately in the center of the base. Further, the solid outer face of cover 46 provides a particle filtering function.

Reference is now made to FIGS. 5–11, wherein an embodiment of the invention is shown that is particularly adapted for use in reducing and substantially eliminating odors emanating from a toilet bowl as a result of human feces being deposited therein. To substantially reduce or eliminate such odors, the liquid in spray dispenser 70 of FIGS. 5–11 preferably includes the enzymes amylase, protease, and lipase, as well as water and the emulsifiers nonylphenol and propylene glycol.

Figure 6:
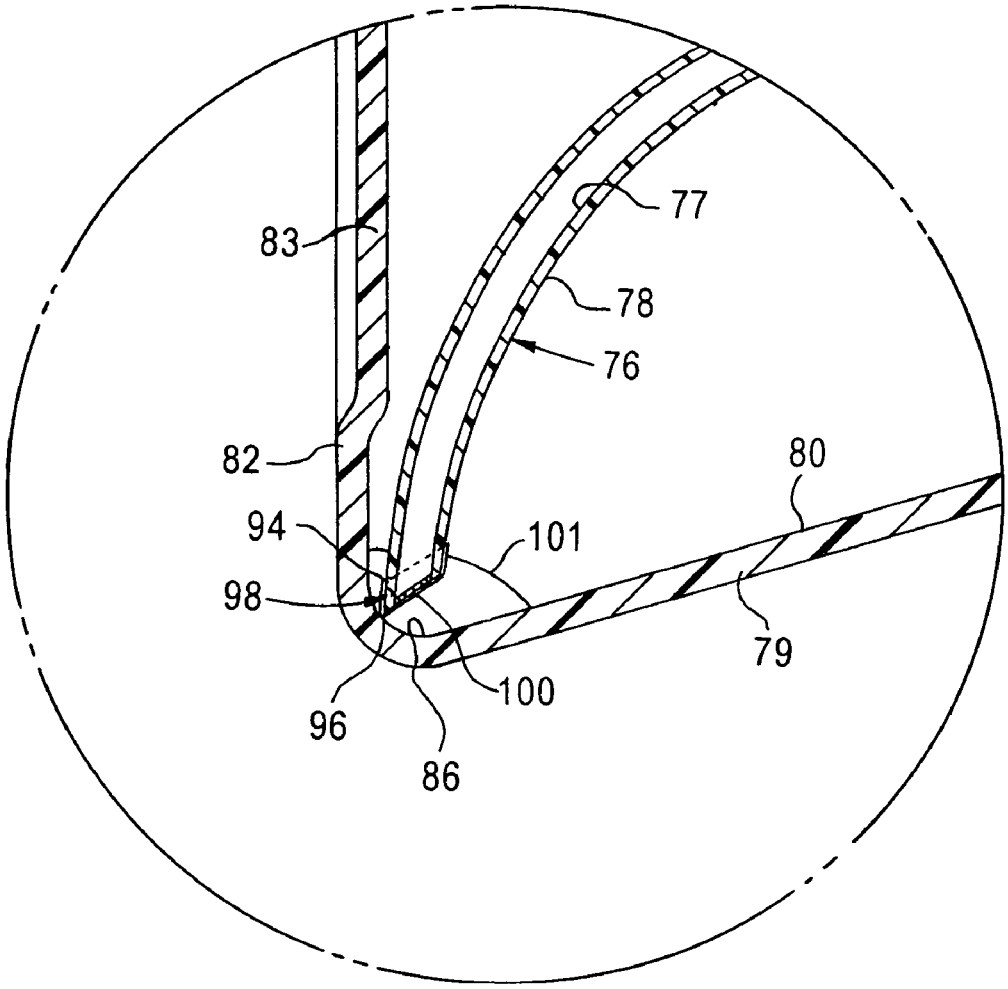
FIG. 6 is an enlarged view of the end of the tube and the intersection of the base and side in the embodiment of FIG. 5, wherein the bottle is positioned so that the longitudinal axis thereof extends substantially horizontally.
Figure 7:
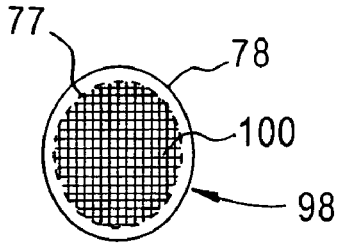
FIG. 7 is a front view of the end of the tube illustrated in FIGS. 5 and 6.

Liquid spray dispenser 70 of FIGS. 5–11 includes a bottle 72, liquid spray nozzle 74, and suction tube 76 having circular inner and outer walls 77 and 78 as shown in FIGS. 6 and 7. (While walls 77, 78 appear to be elliptical in FIG. 7, this is because FIG. 7 is a view of the end of tube 76 that has a diagonal cut.)

Bottle 72 includes a generally longitudinally extending wall 79 and a base 82 that intersects the wall. Wall 79 includes interior wall surface 80, while base 82 has a generally rectangular shape. Base 82 has an interior surface 83 including raised central part 84 for stiffening of bottle 72. Wall 79 and base 82 intersect at rounded corner 86 to provide stability for bottle 72 while the bottle is sitting on a flat horizontal surface, at which time the longitudinal axis of the bottle is vertically disposed.

Suction tube 76 includes an elongated curved portion 90 that extends between first end 92 and second end 94. End 94 of suction tube 76 is cut along a diagonal of the tube to form an elliptical opening. End 94 is capped by cover 98 having an exterior, stiff elliptical face formed by a screen through which openings 100 extend. Cover 98 has a tip 96 that engages and wedges against intersection 86 between wall 79 and base 82. Intersection 86 is aligned with nozzle head 85 so that the intersection is directly under the nozzle head when nozzle 74 is correctly positioned on bottle 72 (as illustrated in FIGS. 5–11), and the bottle base 82 is sitting on a flat horizontal surface. End 92 is fixedly connected to a center portion of liquid spray nozzle 74 so that end 92 of tube 76 is coaxial with collar 75 of spray nozzle 74 that is screwed into threads (not shown) on neck 177 at the upper end of bottle 72. Spray nozzle 74 includes trigger 83 that is substantially the same as trigger 36. Nozzle 74 also includes spray head 85 that is the same as nozzle spray head 34 of nozzle 14.

Nozzle 74 is somewhat different from nozzle 14 because nozzle 74 includes flange 179 having longitudinally extending grooves (not shown) that engage grooves 81 in collar 75 to enable nozzle 74 to be turned about the longitudinal axis of bottle 72 and neck 177. Nozzle 14 has no similar structure because of the cylindrical nature of bottle 12 and the fact that bottle 12 is held, in use, so the longitudinal axis thereof is generally vertically disposed. In contrast, the cross sections of bottle 72 at right angles to the longitudinal axis of bottle 72 are rectangular. Further, in use, bottle 72 is held so the longitudinal axis thereof is generally horizontally disposed, as illustrated in FIG. 8.

Figure 8:
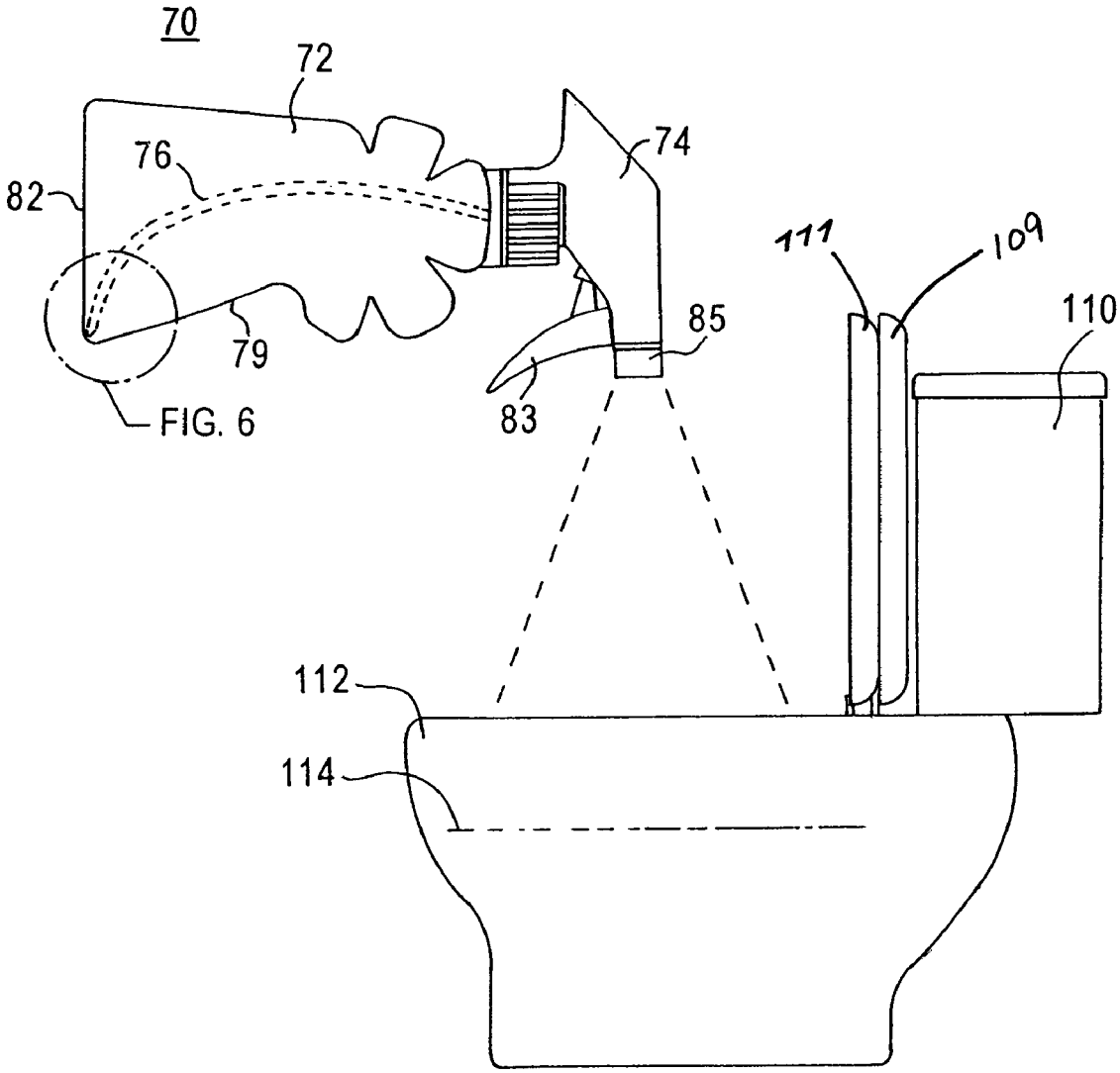
FIG. 8 is a diagram indicating how the dispenser of FIGS. 5–7 is employed for reducing and virtually eliminating odors emanating from human feces deposited in a toilet bowl as a result of a bowel movement.
Figure 9:
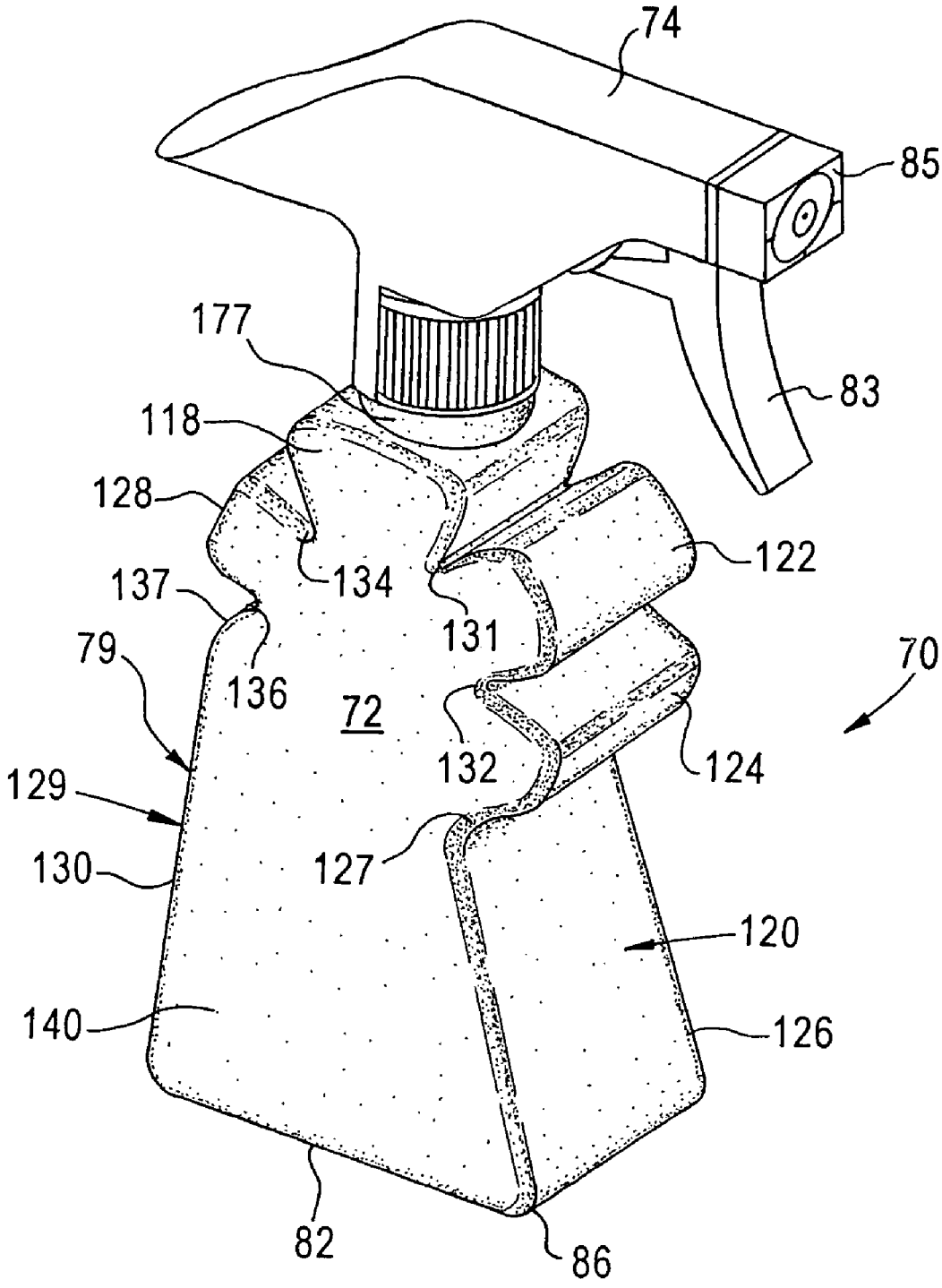
FIG. 9 is a perspective view of the dispenser illustrated in FIGS. 5–8.

A primary use of liquid spray dispenser 70 is for spraying a deodorizing liquid into toilet bowl 112 and onto water pond 114 of toilet 110 of FIG. 8. In this use, nozzle head 85 points downwardly and the longitudinal axes of bottle 72 and suction tube 76 are generally horizontally disposed. In such a use, the liquid in bottle 72 has a tendency to flow to intersection 86, where tip 96 is located, as illustrated in FIGS. 6 and 8. As the volume of liquid in bottle 72 is exhausted, liquid pool 101 forms at intersection 86, against which tip 96 abuts. As a result, virtually all of the liquid in bottle 72 can be drawn from the bottle through tube 76 and sprayed through nozzle 74. Removal of liquid from bottle 72 can continue until the area of openings 100 in the end face of cover 98 exposed to air becomes sufficiently great that air, instead of liquid, is sucked into the interior of tube 76 in response to squeezing of trigger 83.

Tube 76 is considerably longer than the straight line distance between the point where tube end 92 engages liquid spray nozzle 74 and intersection 86. As a result, the elongated portion 90 of tube 76 is curved such that the elongated tube portion 90 bends away from the side of wall 79 where tip 96 is located. The length of tube 76, however, is not sufficiently great to cause any the portion of the tube between its first and second ends 92 and 94 to touch any portion of the interior of base 82 other than intersection 86 against which tip 96 is wedged. It is not feasible for the portion of tube 76 between the first and second ends 93 thereof to engage base 82 other than at intersection 86, because of the non-circular shape of bottle 72 and the fact that nozzle head 34 points downwardly when in use for the primary purpose of dispenser 70. Tip 96 and therefore intersection 82 must be on the same side of bottle 72 as the pointing direction of nozzle 34 when dispenser 70 is in use for its primary purpose. Tube 76 is sufficiently long and bendable to cause tip 96 to be wedged against corner 86 to maximize the amount of liquid that can be sucked from bottle 72.

Bottle 72 has an aesthetic shape simulating four petals and the stem of a plant. The petals and stem are configured so that liquid droplets remaining thereon after a spraying operation fall by gravity to base 82 when bottle 72 is placed in a rest condition so base 82 is on a flat horizontal surface and the bottle longitudinal axis is vertical. The petals are designed so undulations forming the petals do not retain liquid while bottle wall 79 is vertically disposed and the volume of liquid is less than the volume of the bottle below the lowest part of any of the petal-forming undulations.

Upper portion 118 of wall 79 of bottle 72 has undulations causing the upper portion to simulate the appearance of a plant petal. Neck 177 extends upwardly from upper portion 118. Wall 79 includes side 120, which faces in the same direction as nozzle head 85 relative to the longitudinal axis of bottle 72. Side 120 includes vertically stacked undulating segments 122 and 124, shaped to simulate the appearance of two petals of the plant. Side 120 also includes straight segment 126 that tapers outwardly from the lowest portion of lower undulation 124 to base 82. The petal formed by undulation 124 is connected to straight tapering section 126 by arc 127.

Wall 79 includes a second side 129 opposite from side 120 so that side 129 faces away from nozzle head 85 relative to the longitudinal axis of bottle 72. Side 129 includes undulating section 128, shaped to simulate the appearance of a plant petal. Side 129 also includes straight tapering section 130 that tapers outwardly from the lowest portion of undulating segment 128 to base 82. In cross-section, straight segments 126 and 130 have an appearance such that they simulate the stalk of the plant including the petals formed by undulations 118, 122, 124, and 128.

The various petals intersect in crevices 131, 132, 134 and 136, respectively, positioned to enable the index finger, ring finger, pinkie finger, and thumb of a user to engage them, while the index finger of the user engages trigger 83. Crevice 131 is formed at the intersection of undulations 118 and 122; crevice 132 is formed at the intersection of undulations 122 and 124; crevice 134 is formed at the intersection of upper portion 118 of bottle 72 and undulation 128; and crevice 136 is at the intersection of undulation 128 and curved upper arcuate segment 137 of side 129 that leads to straight segment 130. In use, while the index finger of the user engages trigger 83, the thumb of the user engages the surfaces leading to crevice 134 or crevice 136, while the forefinger, ring finger, and pinky finger of the user engage the surfaces leading to crevices 131, 132 and arc 127, respectively.

Undulations 118, 122, 124, and 128, in combination with crevices 131, 132, 134, and 136, further in combination with arcs 127 and 137 and straight tapering segments 126 and 130, are shaped so that droplets on any of these surfaces eventually fall by gravity toward base 82, while base 82 is on a horizontal surface. Consequently, a virtually infinitesimal amount of residual liquid remains in bottle 72 when the liquid is incapable of being sucked further from the bottle as a result of the shape of the bottle and the abutting position of tip 96 against intersection 86.

Figure 10:
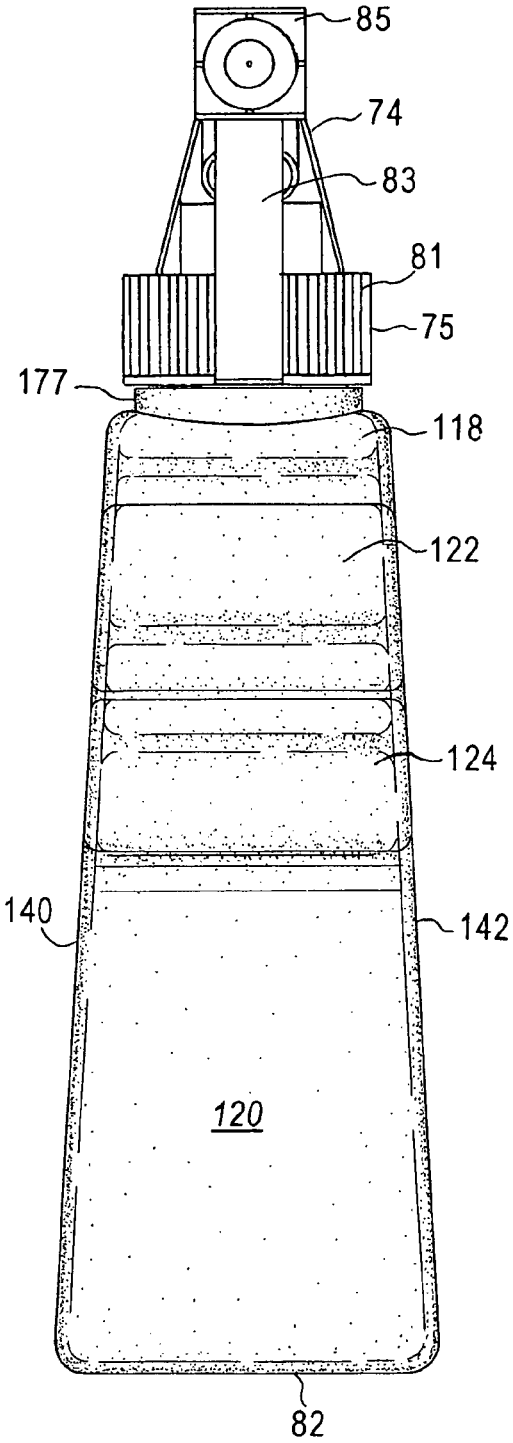
FIG. 10 is a front view of the dispenser illustrated in FIGS. 5–9.
Figure 11:
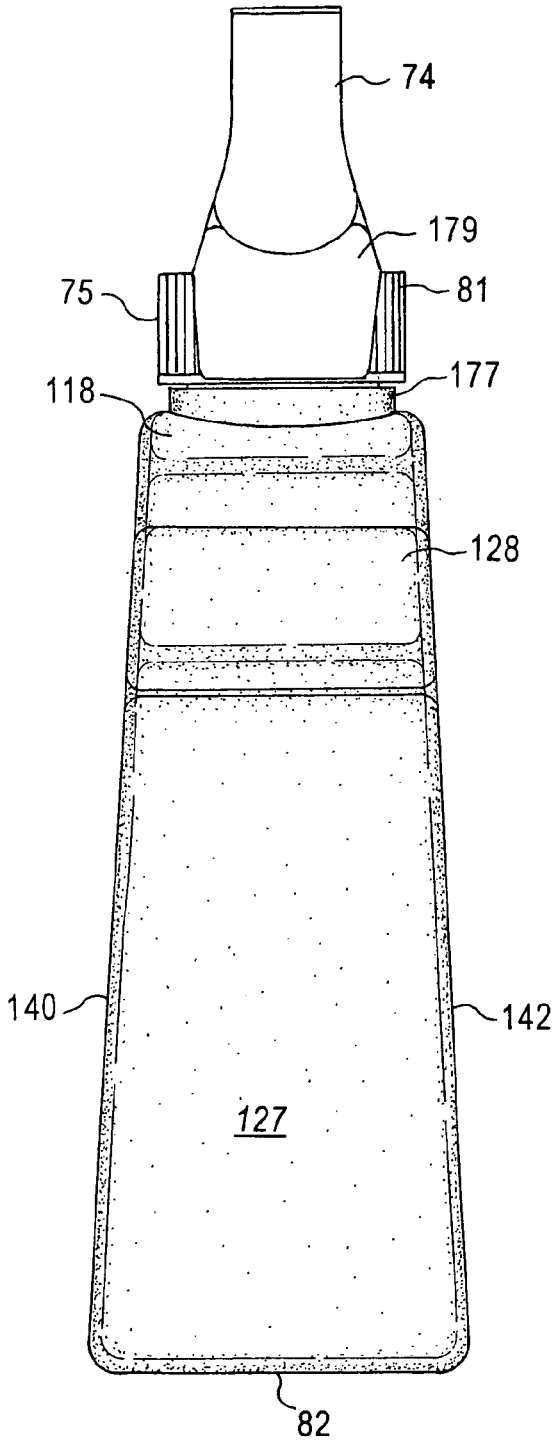
FIG. 11 is a back view of the dispenser illustrated in FIGS. 5–10.

As illustrated in FIGS. 10 and 11, wall 79 includes third and fourth opposite straight sides 140 and 142 that taper outwardly from neck 177 to base 82. The outward taper of sides 140 and 142 also assists in causing all droplets remaining on the interior surfaces of bottle 72 to fall by gravity toward base 82 when the base is on a horizontal surface.

While there have been described and illustrated specific embodiments of the invention, it will be clear that variations in the details of the embodiments specifically illustrated and described may be made without departing from the true spirit and scope of the invention as defined in the appended claims.

What is claimed is:

1. A suction tube for use with a liquid dispenser bottle having a known size and shape in combination with a spray nozzle positioned on the bottle, the spray nozzle having a structure for receiving and holding a first end of the tube, the tube comprising a wall having a length and shape between the first end thereof and a second end hereof such that the tube, when held by the spray nozzle and in place in the bottle, has the second end thereof abutting a corner of the bottle, the bottle corner being the lowest point of the bottle when the bottle is in use and liquid is almost exhausted from the bottle, the tube wall being constructed so that the tube wall has a tendency to collapse in response to contact occurring between the tube wall and the bottle, the second end having a structure extending between opposite sides of the tube wall for strengthening the tube wall and overcoming the tendency of the tube wall to collapse, the structure at the second end of the tube including an opening arrangement for enabling the liquid to flow from the corner of the bottle into the tube.

2. The suction tube of claim 1, wherein the structure at the second end of the tube includes a substantially planar surface on the exterior of the tube.

3. The suction tube of claim 2, wherein the planar surface has a perimeter that is the same as the perimeter of the exterior of the wall of the tube at the second end of the tube.

4. The suction tube of claim 3, wherein the exterior of the wall of the tube at the second end of the tube has a circular face substantially at right angles to the length of the tube.

5. The suction tube of claim 3, wherein the exterior of the wall of the tube at the second end of the tube has an elliptical face that extends along a diagonal relative to the length of the tube, and the wall of the tube is circular in cross-section.

6. The combination of the tube of claim 1 and the bottle and spray nozzle for which the tube is to be used.

7. The combination of claim 6, wherein the bottle includes a wall and a base, the walls of the bottle and the tube extending between the spray nozzle and the base, the walls, base, and nozzle being arranged so the bottle corner is the lowest point of the bottle when the wall of the bottle is generally horizontally disposed and the nozzle is pointing downward.

8. The combination of claim 7, wherein the tube extends arcuately between the nozzle and corner so there is contact of the tube and the bottle and between the fist and second ends only where the second end abuts the corner, the opening arrangement being generally vertically positioned at the corner when the base is horizontally disposed.

9. The combination of claim 8, wherein the exterior of the wall of the tube at the second end of the tube has a circular face substantially at right angles the length of the tube.

10. The combination of claim 7, wherein the corner is at an intersection between the bottle wall and base, and the tube extends between the nozzle and corner so there is contact between the tube and a substantial portion of the bottle base.

11. The combination of claim 10, wherein the exterior of the wall of the tube at the second end of the tube has a circular face substantially at right angles to the length of the tube.

12. The combination of claim 11, wherein the bottle base has a circular perimeter, and the corner is at an intersection of (a) a portion of the bottle wall having a circular interior cross-sectional surface and (b) the circular perimeter of the base.

13. The combination of claim 7, wherein the wall has undulations shaped for (a) causing liquid in the bottle to flow from the undulations toward the base while the bottle wall is vertically disposed, and (b) preventing retention of liquid in the bottle when the volume of the liquid in the bottle is less than the volume of the bottle below the lowest part of any of the undulations.

14. The combination of claim 13, wherein the undulations are shaped to simulate petals of a plant, the bottle wall having substantially straight segments between the bottom portions of the petal and the base on opposite sides of the bottle, a first of the straight segments on a first side of the bottle leading to said corner, and a second of the straight segments on a second side of the bottle leading to a second corner, the second side of the bottle being opposite to the first side of the bottle, the second corner of the bottle being opposite to the first corner, the wall including third and fourth opposite sides tapering outwardly toward the base from an end of the bottle receiving the spray nozzle, the straight segment of the first side of the bottle leading toward the corner having a smaller angle relative to the base than the straight segment and the second side of the base.

15. The combination of claim 14, wherein the undulations are shaped and sized so that the first and second sides of the wall include crevices for receiving the fourth finger and thumb of a user while the index finger of the user engages a trigger of the spray nozzle.

16. The combination of claim 15, wherein the base and wall of the bottle have rounded corners at the intersections thereof.

17. The combination of claim 16, wherein the exterior of the wall of the tube at the second end of the tube has a circular face substantially at right angles the length of the tube.

18. The combination of claim 6, wherein the exterior of the wall of the tube at the second end of the tube has an elliptical face that extends along a diagonal relative to the length of the tube, and the wall of the tube is circular in cross-section.

19. The combination of claim 6, wherein the exterior of the wall of the tube at the second end of the tube has a circular face substantially at right angles to the length of the tube.

20. A liquid spray dispenser comprising a liquid dispenser bottle, a spray nozzle, and a suction tube, the spray dispenser being arranged to carry the suction tube, an upper end of the bottle being arranged for carrying the spray nozzle, the bottle including walls and a base, the walls of the bottle extending between the spray nozzle and the base, the wall, base, and nozzle being arranged so a corner of the bottle, at an intersection of the base and the walls, is at the lowest point of the bottle when the wall of the bottle is generally horizontally disposed and the nozzle is pointing downward, the wall having an undulation for (a) causing a liquid in the bottle to flow from the undulation toward the base while the bottle wall is vertically disposed, and (b) preventing retention of the liquid in the undulation while the bottle wall is vertically disposed and the volume of liquid in the bottle is less than the volume of the bottle below the lowest part of any of the undulations.

21. The liquid spray dispenser of claim 20, wherein a plurality of undulations are included and shaped to simulate petals of a plant, the bottle wall having substantially straight segments between the bottom portions of the petal and the base on opposite sides of the bottle, a first of the straight segments on a first side of the bottle leading to said corner, and a second of the straight segments on a second side of the bottle leading to a second corner, the second side of the bottle being opposite to the first side of the bottle, the second corner of the bottle being opposite to the first corner, the wall including third and fourth opposite sides tapering outwardly toward the base from an end of the bottle receiving the spray nozzle, the straight segment of the first side of the bottle leading toward the corner having a smaller angle relative to the base than the straight segment and the second side of the base.

22. The liquid spray dispenser of claim 21, wherein the undulations are shaped and sized so that the first and second sides of the wall include crevices for receiving the fourth finger and thumb of a user while the index finger of the user engages a trigger of the spray nozzle.

23. The liquid spray dispenser of claim 22, wherein the base and wall of the bottle have rounded corners at the intersections thereof.

24. The liquid spray dispenser of claim 23, wherein the exterior of the wall of the tube at the second end of the tube has a circular face substantially at right angles the length of the tube.

25. The liquid spray dispenser of claim 20, wherein the wall includes undulations shaped and sized so that the first and second sides of the wall include separate crevices for receiving the fourth finger and thumb of a user while the index finger of the user engages a trigger of the spray nozzle.

26. The liquid spray dispenser of claim 25, wherein the base and wall of the bottle have rounded corners at the intersections thereof.

27. The liquid spray dispenser of claim 20, wherein the base and wall of the bottle have rounded corners at the intersections thereof.

28. The liquid spray dispenser of claim 20, wherein the exterior of the wall of the tube at the second end of the tube has a circular face substantially at right angles to the length of the tube.

29. A method of using the dispenser of claim 20, comprising activating the nozzle while (a) the wall of the bottle is horizontally disposed, (2) the nozzle is pointing down and (3) liquid is at the lowest point of the bottle.

* * * * *